US005800217A

United States Patent [19]

Lehner

[11] Patent Number: 5,800,217

[45] Date of Patent: Sep. 1, 1998

[54] ELECTRICAL CONNECTOR INCLUDING AN APPARATUS THEREIN

[75] Inventor: Antonio Lehner, Wiesbaden, Germany

[73] Assignee: The Whitaker Corporation, Wilmington, Del.

[21] Appl. No.: 805,800

[22] Filed: Feb. 25, 1997

[30] Foreign Application Priority Data

Mar. 13, 1996 [DE] Germany ..... 196 09 873.4

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 5,033,980 | 7/1991 | Watanabe et al. | 439/752 |
| 5,167,534 | 12/1992 | Ohsumi | 439/752 |
| 5,478,262 | 12/1995 | Yamanashi et al. | 439/752 |

FOREIGN PATENT DOCUMENTS

| | | |
|---|---|---|
| 0 670 500-A1 | 9/1995 | European Pat. Off. . |
| 0 677 893-A2 | 10/1995 | European Pat. Off. . |
| 0 691 709-A2 | 1/1996 | European Pat. Off. . |
| 44 13 936-A1 | 10/1995 | Germany . |

*Primary Examiner*—Gary F. Paumen
*Attorney, Agent, or Firm*—Driscoll A. Nina

[57] ABSTRACT

An arrangement for contact securing in an electrical connector includes a securing insert, which, with tabs, that constrict the clear width of the chambers by extending through an opening. The securing insert comprises four walls which form a rectangle. One securing insert surrounds a plurality of chambers. The first wall of the securing insert, which has the tabs is displaced by the deformation of the second wall prpendicularly to the plugging direction and thus frees the clear width of the chambers for the contacts by moving the tabs out of the chambers. Upon release of the second wall the elastic nature of the securing insert naturally biases the tabs into the chambers.

9 Claims, 2 Drawing Sheets

ELECTRICAL CONNECTOR INCLUDING AN APPARATUS THEREIN

BACKGROUND OF THE INVENTION

1. Field of the Invention

The invention relates to an electrical connector including an arrangement for securing electrical contacts in a housing.

2. Description of the Prior Art

An electrical connector is disclosed in EP 06 91 709 A2 where multi-pole electrical connector has, in one connector half, a displaceable insert which serves to position the contacts. This interlocking mechanism is embodied by latching cams and first and second latching openings. In this case, it is necessary to apply a force in order to move the latching arms from the first to the second latching opening, from a first pre-latching position to a second final latching position. It is often the case that the latching position in which the interlocking mechanism is situated cannot be discerned from the outside.

SUMMARY OF THE INVENTION

The object of the invention is to specify an arrangement for securing electrical contacts in a housing which enables the contacts to be interlocked in such a way that it is not necessary to apply a force in order to bring the securing insert into the interlocked state.

The objects of the present invention are accomplished by providing an electrical connector having an apparatus for securing contacts within chambers thereof where the connector is characterized in that the apparatus is elastically deformable and has a natural position at least partially obstructing the chambers and a deformed position clear of the chambers.

Specifically, this object is achieved by means of an arrangement for securing electrical contacts in a housing, with the following features: a connector housing having at least two chambers arranged in a row which serve to receive contact; the chambers arranged in a row each have at least one opening on a first side; a securing insert spans the row of chambers and has walls which extend essentially in the plugging direction; a first wall of the securing insert has securing tabs which, in a first, stress-relieved position of the securing insert, engage into the lateral openings in the first side of the chambers and constrict the clear width of the chambers in the plugging direction; a second wall of the securing insert, which second wall connected to and arranged opposite the first wall where the second wall, is elastically deformable whereby elastic deformation of the second wall pushes the first wall perpendicularly to the plugging direction into a second, stressed position, in such a way that the securing tabs are clear of the width of the chambers.

It is advantageous that a plurality of contacts can be secured simultaneously by means of an individual securing insert in a housing and that the securing occurs naturally. This is achieved by virtue of the fact that the securing insert essentially forms a rectangular frame which surrounds all the chambers in a row together. All of the means for securing are arranged in a row and form a plane with the openings of the chambers in which contacts are to be secured and the unstressed state results in securing.

It is furthermore advantageous that the securing insert is simple to produce. This is achieved by virtue of the fact that the securing insert is constructed symmetrically.

It is also advantageous that the securing insert ensures a uniform distribution of the spring forces. This is achieved by virtue of the fact that an elastically deformable wall of the securing insert bears, in a central region, with a web in a complementary groove in a central region of the row of chambers.

It is also advantageous that the securing insert can be guided well. This is achieved by virtue of the fact that the lateral walls of the securing insert rests against the outer walls of the outer chambers, and that the securing insert and the chambers have mutually complementary guide means which are arranged, for example, in a side wall of each chamber.

It is also advantageous that the state of the securing insert can readily be discerned from the outside. This is achieved by virtue of the fact that the securing insert partially projects from a collar of the connector housing.

DETAILED DESCRIPTION OF THE PREFERRED EMBODIMENT

Figure 1:
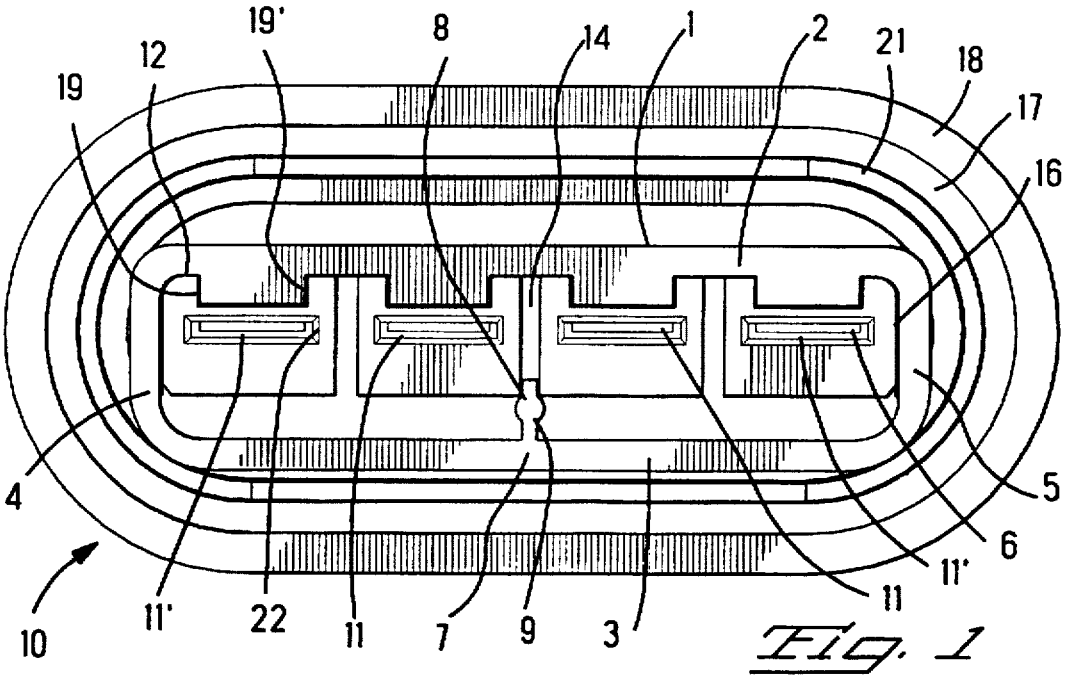
FIG. 1 shows a plan view of a preferred exemplary embodiment, in which the arrangement for securing electrical contacts in a housing is in the stress-relieved state.

FIG. 1 shows a four-pole female connector housing 10 having an oval cross-section. Four chambers 11, 11' are arranged in a row in the connector housing 10. The four chambers 11, 11' are surrounded by a securing insert 1. The securing insert 1 is illustrated in the stress-relieved state and is essentially designed as a rectangular frame with four walls, 2, 3, 4, 5. The securing insert 1 has guide means 19 on the wall 2 of the first long side 19 which guide means are complementary to further guide means 19' on the first side 12 of the chambers 11, 11'. On the second wall 3 of the second long side of the rectangle, the securing insert 1 has, in the central region 7, a web 9 which bears in a complementary groove 14 in the central region between the chambers 11, 11'. As a result of the vertical arrangement of the web 9, the second wall 3 is held at a certain distance from the chambers 11, 11'. The securing insert 1 rests tightly against the outer wall 16 of the outer chamber 11' along the two short walls 4, 5 of the rectangle. At the plugging end, the chambers 11, 11' each have a slot 22, which receives the contact prong (not shown here) in the mating connector. The chambers 11, 11' are illustrated without contacts. That part of the means for securing contacts, tab 6 which projects furthest in the chamber 11, 11', can be discerned through the slot 22 (see also FIG. 4).

Figure 2:
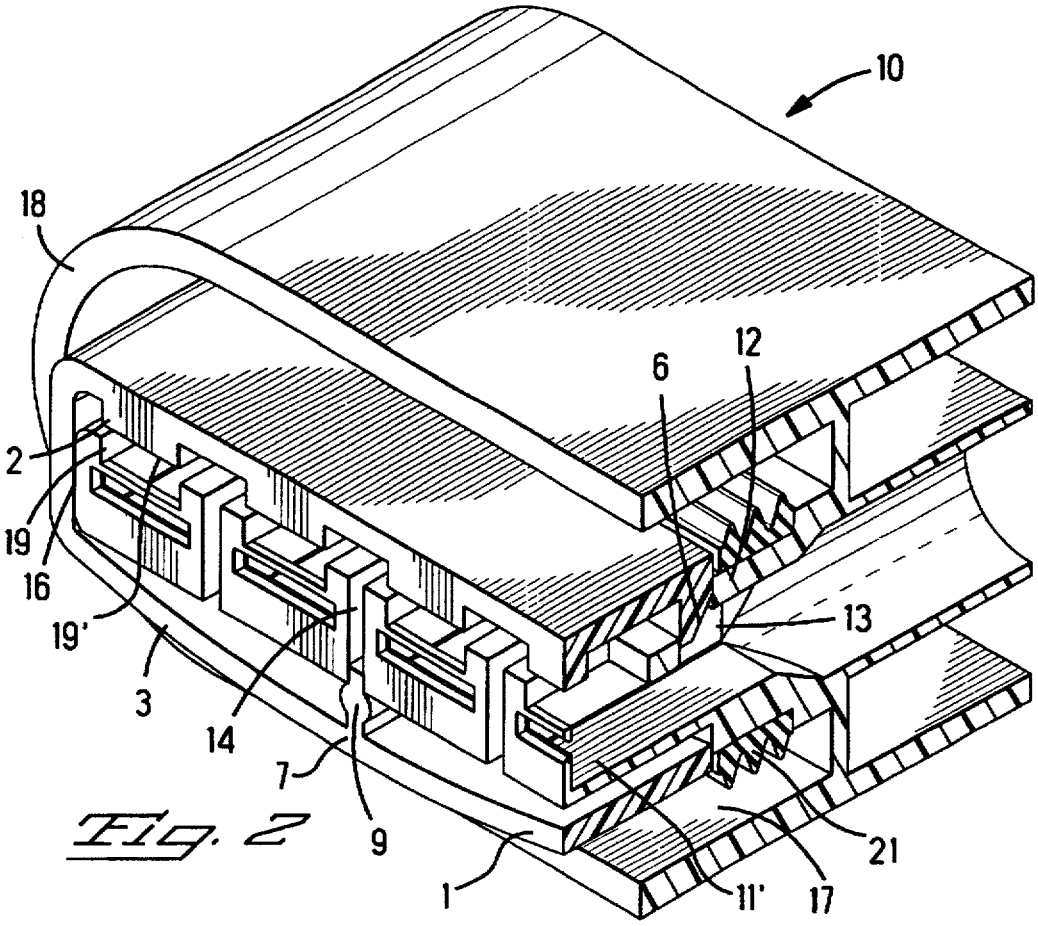
FIG. 2 shows a perspective view of the arrangement which is sectioned in the plugging direction and in which the securing insert is in the second, stressed position.

With reference now to FIG. 2, the outer wall of the connector housing 10 forms a collar 18 in the plugging direction and how the chambers 11, 11' and the securing insert 1 partially projects from the connector housing 10 in the plugging direction. The connector housing 10 has an interspace between the collar 18 and the chambers 11, 11'. A sealing ring 21 is accommodated in a further region of the interspace between the collar 18 and the chambers 11, 11'. A gap 17 remains free between the securing insert and the collar 18 and between the sealing ring 21 and the collar 18, which gap receives a wall part (not shown here) of a complementary mating connector part. The securing insert 1 is shown displaced in this interspace perpendicularly to the plugging direction by exerting a perpendicular force at the corners of wall 3.

FIG. 2 shows the tabs 6 extending into an opening 13 in the first side 12 of the chambers 11, 11' and clear of the width for receiving a contact. The socket contact is introduced into the connector housing 10 from the rear in the plugging direction. For this purpose, the clear width of the chamber 11, 11' must be freed. This is achieved by the displacement perpendicularly to the plugging direction of the first wall 2 and hence also the tabs 6 as is described below.

As a web 9 supports the second wall 3 only in the central region 7, the lateral regions of the second wall 3 can be bent by the application of force perpendicularly to the plugging direction until the second wall 3 is brought toward and placed against the chamber 11'. The second wall 3 acts as a resilient bending beam. Since the two side walls 4 and 5 are short and are arranged vertically, the first wall 2 is displaced perpendicularly to the plugging direction and the means for securing 6 are pushed out of the clear width of the chambers 11, 11'. The securing insert 1 is held in the stressed position until the socket contacts are completely positioned. The second wall 3 of the securing insert 1 remains in the bent state. The contact sockets can now be pushed into the respective contact chambers. When the contact sockets are completely pushed in, the tabs 6 will latch into place and the securing insert will naturally move from the second, stressed position into the first, stress-relieved position.

Figure 3:
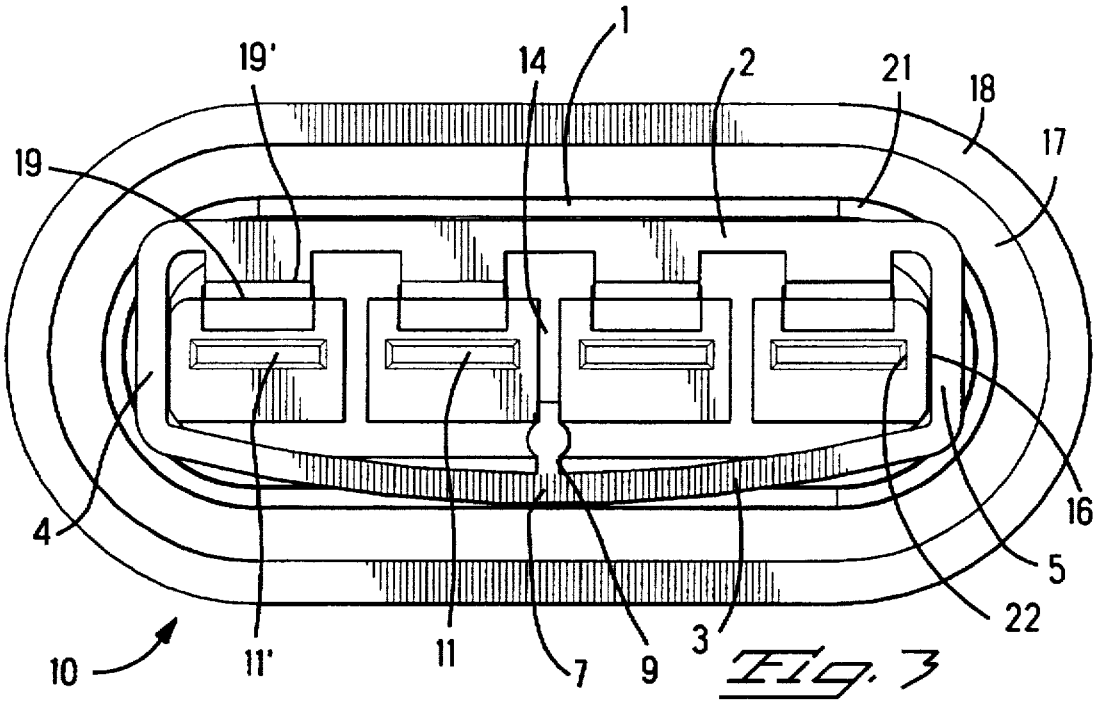
FIG. 3 shows a plan view of the arrangement of FIG. 2.

FIG. 3 shows a plan view of the arrangement for securing in which the securing insert 1 is in the second, stressed position. The second wall 3 of the securing insert 1 is bent perpendicularly to the plugging direction. The lateral walls 4, 5 are displaced perpendicularly to the plugging direction and still bear on the lateral outer walls 16 of the outer chambers 11'. The first wall 2 of the securing insert 1 is displaced together with the lateral walls 4, 5 perpendicularly to the plugging direction. The manner in which the chambers 11, 11' have a free passage for the contacts in the plugging direction can be discerned through the slots 22. In contrast to the situation illustrated in FIG. 1, in FIG. 3 no means for securing 6 are visible in the chambers 11, 11', which means for securing constricted the clear width of the chambers 11, 11' in the stress-relieved position.

Figure 4:
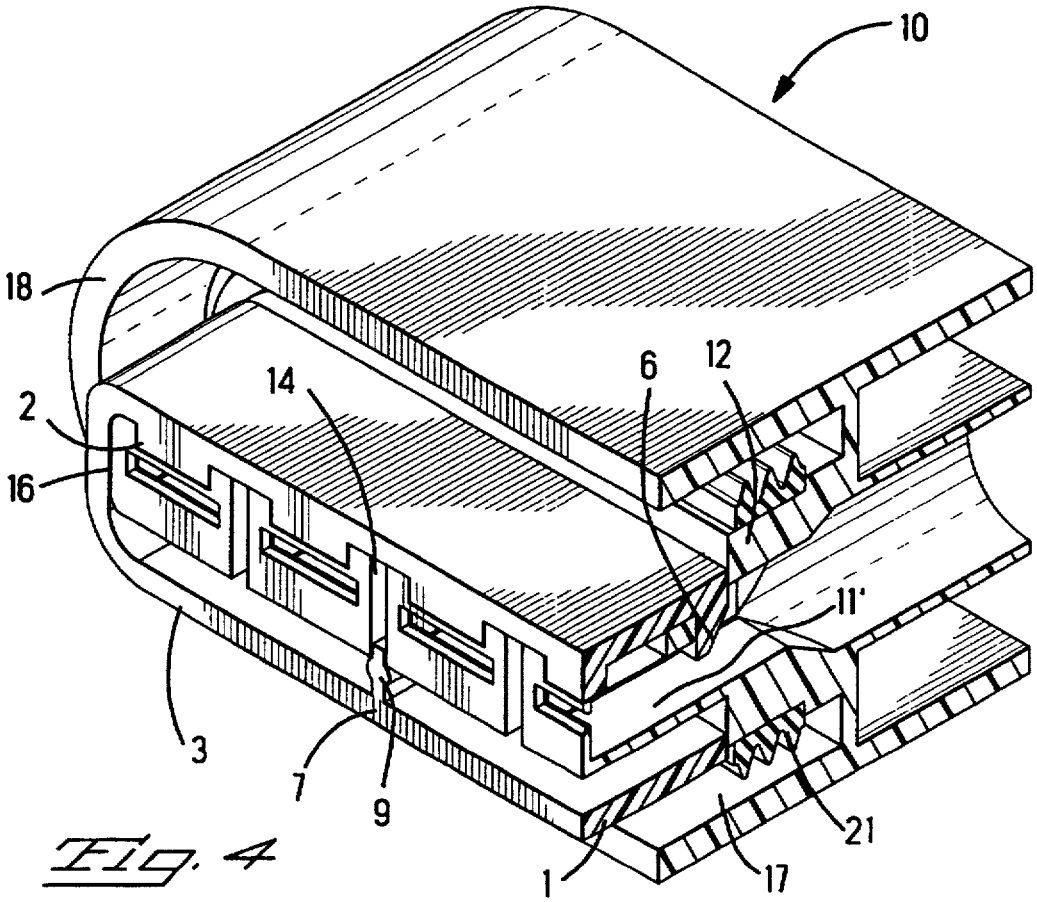
FIG. 4 shows a perspective view of the arrangement which is sectioned in the plugging direction and in which the securing insert is in the first stress-relieved position.

In FIG. 4, the securing insert 1 in the connector housing 10 is again situated in the first, stress-relieved position. The manner in which the means for securing 6 project in the chamber 11' and constrict the clear width for the contact socket can be discerned. The first wall 2 is again situated with the means for guidance 19 in the complementary means for guidance 19' on the first side 12 of the chambers 11, 11'. The second wall 3 of the securing insert 1 has again been stress-relieved and again runs parallel to the chambers 11, 11' at a distance therefrom which remains the same at all points.

The securing insert 1 can also be used analogously in the housing of the mating connector which is not shown here.

I claim:

1. An electrical connector including an apparatus for securing electrical contacts therein, the connector comprising: a connector housing having a chamber therein for receiving a contact wherein a lateral opening extends through the housing and into communication with the chamber; and a securing insert disposed along the housing and having a first wall with tabs extending therefrom and into the lateral openings wherein the securing member has a first position with the tabs extending into the chamber and a second position with the tabs clear of the chamber; the connector being characterized in that a resilient member acts on the first wall of the securing insert to hold the securing insert in the first position, the resilient member being in a natural condition in the first position and a deformed condition in the second position, whereby the securing insert is naturally biased into the first position.

2. The electrical connector of claim 1, further characterized in that the securing insert includes opposed side walls connected to the first wall and the resilient member is a second wall thereof that is located opposite the first wall and connected thereto by way of the opposing side walls such that a box-like structure is formed, the securing insert being disposed about the chamber.

3. The electrical connector of claim 2, further characterized in that the connector housing further includes multiple chambers where between at least one pair of chambers is a central region and the second wall includes a bearing point cooperating therewith to establish the first position.

4. The electrical connector of claim 3 further characterized in that the bearing point is located on a web extending from the second wall.

5. An electrical connector according to claim 2, further characterized in that a complementary groove is included in a central region for engaging the bearing point.

6. An electrical connector according to claim 2, further characterized in that the opposing side walls of the securing insert rest against outer walls of the body along the chambers.

7. An electrical connector according to claims 3, characterized in that the lateral openings in the chambers and the tab of the securing insert are arranged in each case essentially in a row and essentially in one plane perpendicular to the plugging direction.

8. An electrical connector according to claim 3, characterized in that, in the first position, the securing insert essentially forms a rectangular frame which surrounds all the chambers in the row together.

9. An electrical connector according to claim 3, characterized in that the first connector housing along the chambers and the the securing insert have mutually complementary guide means, which serve to guide the securing insert when moving between the first position and the second position.

* * * * *